US009394104B2

(12) United States Patent
Hamilton et al.

(10) Patent No.: US 9,394,104 B2
(45) Date of Patent: Jul. 19, 2016

(54) MATERIAL DELIVERY METHOD AND SYSTEM

(71) Applicant: Vibration Technology Solutions Pty. Limited, Swan Hill (AU)

(72) Inventors: Mike Hamilton, Boronia (AU); James Francis McDiarmid, Swan Hill (AU)

(73) Assignee: Vibration Technology Solutions Pty. Limited, Victoria (AU)

( * ) Notice: Subject to any disclaimer, the term of this patent is extended or adjusted under 35 U.S.C. 154(b) by 176 days.

(21) Appl. No.: 14/374,584

(22) PCT Filed: Jan. 25, 2013

(86) PCT No.: PCT/AU2013/000065
§ 371 (c)(1),
(2) Date: Jul. 25, 2014

(87) PCT Pub. No.: WO2013/110137
PCT Pub. Date: Aug. 1, 2013

(65) Prior Publication Data

US 2015/0034669 A1 Feb. 5, 2015

(30) Foreign Application Priority Data

Jan. 27, 2012 (AU) ..... 2012900304

(51) Int. Cl.
*B65D 88/66* (2006.01)
*B65D 88/26* (2006.01)
*B65D 90/48* (2006.01)

(52) U.S. Cl.
CPC ..... *B65D 88/665* (2013.01); *B65D 88/26* (2013.01); *B65D 90/48* (2013.01)

(58) Field of Classification Search
CPC ..... B65D 88/665; B65D 88/26; B65D 90/48; B65D 88/64; B65D 88/66
USPC ..... 222/196, 198–203
See application file for complete search history.

(56) References Cited

U.S. PATENT DOCUMENTS 3,618,227 A * 11/1971 Breakell ..... F26B 17/1408 222/146.2
3,876,121 A * 4/1975 Preikschat ..... G05D 9/12 222/503

(Continued)

FOREIGN PATENT DOCUMENTS

AU 2004201408 10/2004
GB 1413350 11/1975

(Continued)

OTHER PUBLICATIONS

International Search Report for International Application No. PCT/AU2013/000065 dated Mar. 26, 2013.

*Primary Examiner* — Patrick M Buechner
(74) *Attorney, Agent, or Firm* — Carlson, Gaskey & Olds, P.C.

(57) ABSTRACT

The present invention provides a method of discharging dry bulk material from a container. The method comprises the steps of applying vibration to the container in accordance with a predetermined vibration application routine. A resultant amplitude of vibration of the container resulting from the applied vibration is then monitored to facilitate the determination of a level of dry bulk material present in the container. In the event that the determined level of dry bulk material is above a predetermined level, the application of vibration to the container is ceased for a predetermined time interval. In the event that the determined level of dry bulk material is at or below a predetermined level, the application of vibration to the container is maintained in accordance with the predetermined vibration application routine.

14 Claims, 2 Drawing Sheets

(56) References Cited

U.S. PATENT DOCUMENTS 4,170,311 A * 10/1979 Spaw ..... B65D 90/48 414/289
4,836,417 A * 6/1989 Uchiyama ..... B65B 37/04 222/198
5,522,512 A * 6/1996 Archer ..... B07C 5/342 209/580
2001/0038051 A1 11/2001 Okabe

FOREIGN PATENT DOCUMENTS

GB 2008809 6/1979
SU 821320 6/1979
WO WO 2008138045 A1 * 11/2008 ..... B65D 88/665

* cited by examiner

MATERIAL DELIVERY METHOD AND SYSTEM

RELATED APPLICATIONS

This application claims priority from Australian Provisional Patent Application No. 2012900304, filed 27 Jan. 2012, the entire contents of which are incorporated herein by reference.

FIELD OF INVENTION

The present invention relates to a method and system for assisting the controlled delivery of dry bulk material from a storage container, and in particular, to a system for assisting in the controlled delivery of dry bulk material from a hopper through the application of vibration energy to assist in the discharge of particulate material therefrom.

BACKGROUND ART

Dry bulk material, such as grain, compounds, chemicals, pharmaceuticals, fertilisers, minerals, and a combination of such materials, are typically stored in storage containers, such as hoppers, silos and the like. Such storage containers typically have a body configured to receive the material therein, and an outlet provided on a lower region of the body through which the dry bulk material can flow to exit the storage container, typically under the force of gravity.

In agricultural applications, grains such as wheat, barley and the like, are typically harvested from a crop and delivered from the field into large hoppers or silos, where they are stored in a controlled environment. In many instances, hoppers that are provided for the storage of grains typically have an outlet formed in a bottom region thereof that provides an egress point for the grain to be collected for transport and delivery to a variety of end users. Typically, such hoppers comprise a cylindrical body portion having a lower cone region that tapers towards the outlet, which may be located in the wall of the lower cone region. Thus, delivery of the grain from the outlet is achieved under gravity forces whereby the grain behaves like a fluid that flows towards and through the outlet. An auger may also be used adjacent the outlet to assist in extracting the flow of grain from the outlet, to an elevated collection point, For primary producers, such as grain farmers, it is of primary importance that a storage hopper is fully discharged of grain from time to time. This is important from an economical perspective as the grain has commercial value and it is in the best interests of the primary producer to ensure that maximum profit is obtained from their crops. Further to this, it is also important from a primary producer's perspective to fully discharge a hopper to prevent disease and pest infestation. This may occur when grain is stored in a hopper for long periods, as may happen if the hopper is not fully discharged.

The speed and complete discharge of grain from a silo is also if particular importance to the transport operator responsible for the collection and delivery of the grain from the silo. Transport operators typically operate vehicles having large storage tanks to receive the grain for transport. The transport operators typically collect the stored grain from the storage hoppers located on farms and the like. In order to collect the grain from the storage hoppers the transport operators arrange their vehicles such that the grain flows into their storage tanks from the hopper, typically via an auger or similar conveying device. Many transport operators may be required to attend a number of storage hoppers in a typical work day and in order to provide an efficient collection service, it is fundamental that the time taken to discharge the storage hopper into the storage tanks of the vehicle is minimised. Any blockages of flow of grain from the storage hopper, or reduction in flow can have a significant adverse effect on the efficiency of the transport operator, which may impact the transport operator's financial position through loss of income and generate a cost that may be passed on to the primary producer.

In this regard, a common problem with conventional grain storage hoppers is that the lower cone regions of the hoppers are typically very shallow, making it difficult to fully discharge the hoppers, particularly the last few tonnes of grain that is stored in the silo. In such instances, the grain tends to settle upon the shallow inside walls of the lower cone region such that it no longer behaves like a fluid, but becomes static. Thus, it has been known for many Owners and operators of the hoppers to heavily strike the external walls of the cone region in an attempt to induce flow back into the static grain particles. However, such an action often results in the walls of the hopper becoming damaged or dimpled, which may cause additional problems to the fluid flow of the grain, and thus the future usefulness of the hopper, as the inner surface of the hopper may provide a pitted surface upon which the grains collect.

It has also been known for operators to enter into the hoppers or silos during the discharging process to manually assist in moving the grain toward the outlet, with the use of shovels or other manual means. However, this is a very dangerous practice and presents a significant safety risk to the operator, as an operator may sink into the grain and suffocate, or come into contact with an auger or the like which could cause significant injury, and in extreme cases, death. Further to this, the internal environment of a silo or hopper is often filled with grain dust or husks which could cause considerable harm to the operator's lungs and respiratory system, and which may ignite or become explosive when exposed to a spark.

To address this issue, and to induce fluid flow into the stored particles of grain, a variety of shaking or vibrating devices have been proposed, which attempt to apply a constant vibration to the walls of the hopper so as to impart energy to the grain. Most such proposals are directed towards supplying a dedicated device driven by mains electricity so as to operate at a single frequency, namely mains frequency (50 or 60 Hz). However, as most silos and grain storage hoppers are often located remote from a mains power supply, such devices are not applicable to most grain collection situations and are not portable, so have a limited application.

More recently, a portable device such as that disclosed in the present applicant's co-pending International PCT Application No, PCT/AU2008/000653, the contents of which are incorporated herein by reference, has been proposed. Such a device offers a significant improvement over previous devices by providing a means for monitoring the amplitude of vibration applied, and automatically regulating the frequency and amplitude of the applied vibration in accordance with predetermined characteristics. In particular, such a system sought to detect the resonant frequency of the hopper as the hopper discharges and to control the vibratory stimulus accordingly, such that the stimulus was maintained as close to the resonant frequency of the hopper and contents as possible throughout the discharging process.

However, such an arrangement requires constant delivery of a vibratory stimulus at or around resonant frequency. This has a significant drain on power requirements and has the potential to send the physical structure of the hopper into structural resonance, which may compromise the structural integrity of the hopper.

Thus, there is a need to provide a system of controlling the vibratory, stimulus applied to a storage container, such as a hopper, that maximises the efficient use of the gravity forces to cause fluid flow of the material and which maintains the applied stimulus within safe and predetermined levels, whilst providing complete and rapid discharge of the grain from the hopper.

The above references to and descriptions of prior proposals or products are not intended to be, and are not to be construed as, statements or admissions of common general knowledge in the art. In particular, the above prior art discussion does not relate to what is commonly or well known by the person skilled in the art, but assists in the understanding of the inventive step of the present invention of which the identification of pertinent prior art proposals is but one part.

STATEMENT OF INVENTION

The invention according to one or more aspects is as defined in the independent claims. Some optional and/or preferred features of the invention are defined in the dependent claims.

Accordingly, in one aspect of the invention there is provided: a method of discharging dry bulk material from a container, comprising the steps of:

a) applying vibration to the container in accordance with a predetermined vibration application routine;

b) monitoring a resultant amplitude of vibration of the container resulting from the applied vibration;

c) determining a level of dry bulk material present in the container;

wherein, in the event that the determined level of dry bulk material is above a predetermined level, ceasing the application of vibration to the container for a predetermined time interval; or in the event that the determined level of dry bulk material is at or below a predetermined level, maintaining the application of vibration to the container in accordance with the predetermined vibration application routine.

In one embodiment, the step of determining the level of dry bulk material present in the container comprises assessing the resultant amplitude of vibration of the container against a predetermined set point level amplitude. The predetermined set point level amplitude may be an amplitude of vibration representative of the level of dry bulk material being at or adjacent a lower cone portion of the container.

The predetermined vibration application routine may comprises applying a linear sweep of vibration to the container between a predetermined frequency range over a predetermined time interval.

The step of monitoring the resultant amplitude of vibration may comprise mounting an accelerometer to a wall of the container to measure the resultant vibration.

The step of ceasing the application of vibration to the container may comprise repeating steps a)-c) after the predetermined time interval has lapsed.

The step of maintaining the application of vibration to the container in accordance with the predetermined vibration application routine may comprise repeatedly applying a linear sweep of vibration to the container between predetermined frequency levels. A further step of monitoring the resultant vibration of the container resulting from the predetermined vibration application routine against a second set point level representative of a critical structural resonance zone of the container may be employed. In this embodiment, upon determining that the resultant vibration of the container resulting from the predetermined vibration application routine exceeds the second set point level, the predetermined vibration application routine may be ceased for a predetermined interval. In another embodiment upon determining that the resultant vibration of the container resulting from the predetermined vibration application routine exceeds the second set point level, the predetermined vibration application routine may ceased until reactivated by an external operator.

The predetermined vibration application routine may comprise at least one burst of a linear sweep of vibration to the container outside said predetermined frequency level to avoid compaction of the day bulk material within the container.

According to a second aspect of the invention, there is provided a system for discharging dry bulk material from a container, comprising:

a vibration unit attachable to a wall of the container and configured to apply vibration to the container;

a feedback unit attachable to the container so as to determine an amplitude of resultant vibration of the container in response to the vibration applied by the vibration unit and configured to generate a feedback signal indicating said determined amplitude of resultant vibration; and a control unit for controlling the operation of the vibration unit in accordance with the method as defined by any one or more of claims 1-11.

BRIEF DESCRIPTION OF THE DRAWINGS

The invention may be better understood from the following non-limiting description of preferred embodiments, in which.

DETAILED DESCRIPTION OF THE DRAWINGS

Preferred features of the present invention will now be described with particular reference to the accompanying drawings. However, it is to be understood that the features illustrated in and described with reference to the drawings are not to be construed as limiting on the scope of the invention.

The present invention will be described below in relation to a particular preferred embodiment, where the system is employed in a grain hopper to facilitate the delivery of grain, such as wheat or barley. It will be appreciated that the present invention could be equally applied to a variety of different types of dry bulk materials and containers for storing such materials. In particular, the present invention could be applied to the storage and discharge of fertilizers, mineral sands, powders, as well as dirt and soil aggregates which may be a result of a mining process which typically require collection, storage and later discharge from a hopper. Further, the present invention may also be applied to the storage and discharge of dry bulk materials which may include matter having varying particle sizes.

Figure 1:
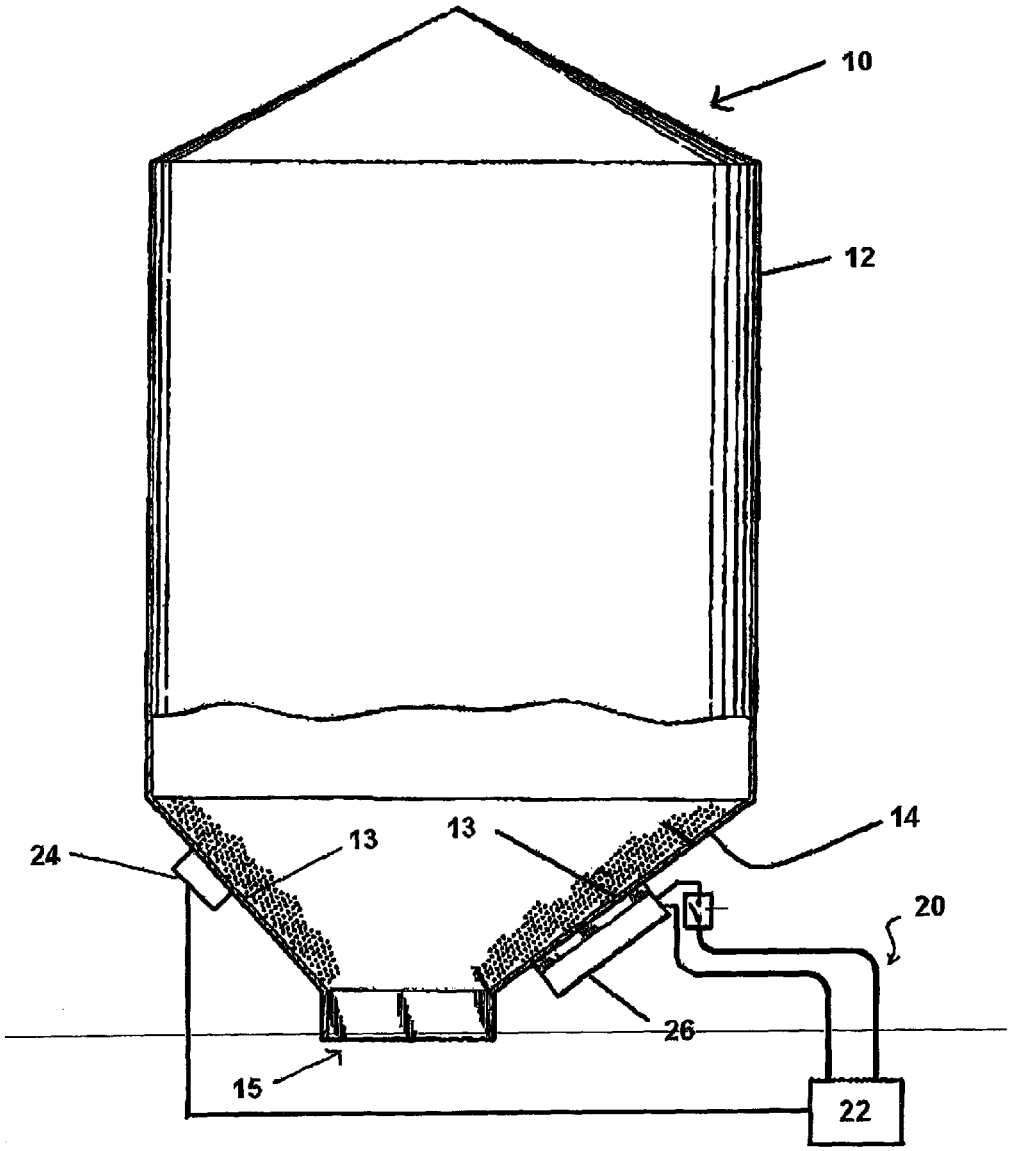
FIG. 1 is view of a vibration system according to an embodiment of the present invention in use on a grain silo.

Referring to FIG. 1, a silo or hopper 10 for storing grain is shown. The hopper 10 comprises a generally cylindrical body portion 12 and a lower cone portion. 14. The lower cone portion 14 comprises angled walls 13 that extend towards a delivery outlet 15 located in a substantially central position as shown. Whilst not shown, an auger conveyer may also be located within the delivery outlet 15 to further assist in the removal of material from the hopper 10.

It has been found that when grain is stored in a hopper 10, the effect of gravitational forces or pressure on the granules causes the grains to behave like a fluid and flow towards a path of least resistance. Thus, when grain is delivered into a silo or hopper 10, it will typically settle in the hopper 10 as it fills, so as to form a cone under the delivery point. In such instances the angle of the cone thus formed will vary depending upon the type of grain being stored in the hopper 10.

This is achieved due to the presence of surface friction between the individual grains and the point at which the surface friction between grains is equal to the downward gravity force results in the grains no longer exhibiting fluid characteristics, but reaching a point of equilibrium.

Such an arrangement also exists when the hopper 10 is being discharged or emptied. In this regard, if the angle of the walls 13 of the lower cone portion 14 is at a lower angle than the equilibrium point of the grains, then the grain will cease to flow in the presence of gravity force alone. This is typically achieved when the level of grain present in the hopper 10 is at or below the level of the lower cone portion 14. In practice this phenomena can be readily identified through observing the gradual reduction of the grain discharge rate from the hopper 10 until it reaches a point where the grain ceases to be discharged, despite the obvious presence of grain within the hopper 10.

Thus, in order to restore the flow of the grain under the effects of gravity it is necessary to apply an external source, of energy to the grain to break the grain-to-grain surface friction. This is achieved through the application of vibration energy to the lower cone portion 14 by the vibration system 20.

Figure 2:
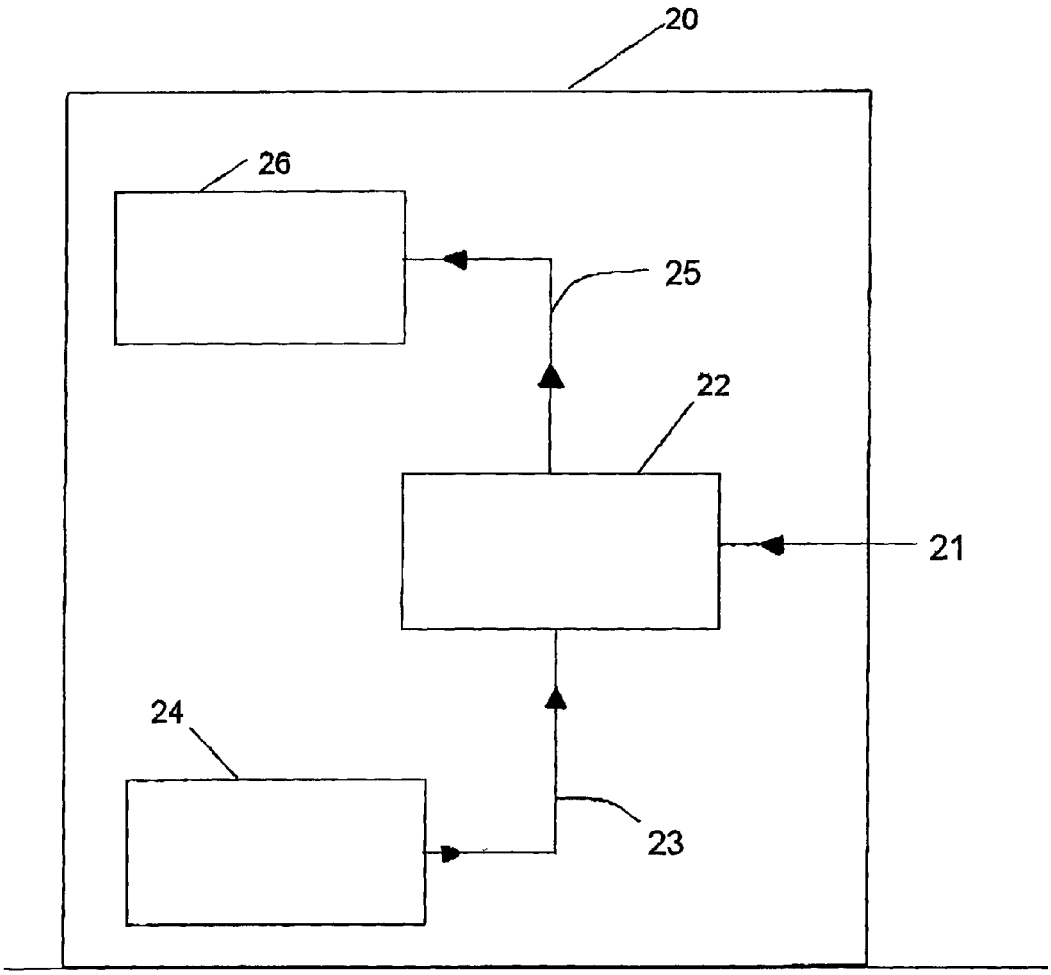
FIG. 2 is a simplified diagram showing the vibration system of the present invention.

The vibration system 20 in accordance with an embodiment of the present invention is shown in FIG. 2. The vibration system 20 comprises a main control unit 22, feedback unit 24 and a vibration unit 26. The main control unit 22, feedback unit 24 and the vibration unit 26 are each connected by way of a cable or wirelessly, as depicted by the arrowed lines, to facilitate flow of control signals within the system 20.

The control unit 22 is in the form of a portable computer processor having an internal amplifier for outputting a stimulus signal to the vibration unit 26 in a low frequency audio range of approximately 10-200 Hz. The control unit 22 receives power from an external power source 21, such as a standard 12 volt car battery, which may be an external battery or present in a vehicle. Alternatively, the control unit 22 may contain its own rechargeable power source.

The control unit 22 receives feedback signals 23 from the feedback unit 24 and processes the signals in accordance with a predetermined control algorithm to generate stimulus signals 25 to send to the vibration unit 26 for application to the lower cone portion 14 of the hopper 10, in a manner to be discussed in more detail below.

In a preferred arrangement, the vibration unit 26 is configured to be mounted to the shallowest external wall 13 of the lower cone portion as shown in FIG. 1. In this regard, the vibration unit 26 comprises a magnetic latching mechanism of sufficient strength to facilitate latching to the walls 13, such that a vibrating mechanism is in contact with the walls 13 to impart vibration energy thereto. The vibration unit 26 may comprise a release mechanism for detaching the unit 26 from the wall 13 of the lower cone portion 14 after use, or as may be desired. The vibration unit comprises a vibration element of a sufficient low frequency (20-200 Hz) for generating up to 800 watts of output vibration (or higher—depending upon the specific application of the device), in accordance with the stimulus signal 25 received from the control unit 22. In this regard, the vibration unit 26 may comprise a receiver to receive and process the signals 25.

The feedback unit 24 is in the form of an accelerometer, such as a tri-axis MEMS accelerometer, packaged with a processing unit that is mounted to the external wall 13 of the lower cone portion 14 preferably on an opposite side of the storage container to the vibration unit 26 and on the wall 13 having a steeper angle than that which the vibration unit 26 is mounted, as is shown in FIG. 1. The feedback unit 24 may comprise casing that houses the accelerometer and processing unit such that the feedback unit 24 is mounted by way of magnetic clamps to the wall 13 in a secure manner. The accelerometer of the feedback unit 24 observes the vibration peak signals from the hopper 10 whereby the processing unit digitises the signals from the accelerometer for transmission to the control unit 22. The signals may be transmitted to the control unit 22 by way of a cable or wirelessly. In this regard, the electrical power required to operate the feedback unit 24 may be derived from the power source 21 or an internal power source may be provided with the feedback unit 24.

It will be appreciated that the vibration system 20 of the present invention provides a means for vibrating the hopper 10, and thus the grain contained therein, and to monitor and control the vibration being applied in accordance with a preset algorithm.

As previously discussed, the vibration system 20 of the present invention is provided to break the grain-to-grain surface fiction to enable the grain (or any other dry bulk or particulate material) to continue to flow under the effects of gravity, whilst the structure of the hopper is continually monitored ensuring that the hopper does not enter structural resonance.

Prior to use of the vibration system 20, the vibration system 20 is calibrated in accordance with the hopper 10 to which it is being used. In this regard, hoppers 10 are generally grouped within three subsets; small, medium, and large. The output from the vibration unit 26 is set in accordance to the size of the hopper 10. By way of an example, for a large hopper the output is set at 750 Watts RMS; for a medium hopper the output is set at 650 Watts RMS; and for a small hopper, the output is set at 550 Watts RMS.

When the vibration system 20 is activated, the base algorithm or'default mode of operation is that the system 20 will apply a repeated linear sweep of vibration of around 32 Hz to 40 Hz for an initial 3 second period followed by a linear sweep of vibration of around 40 Hz to 32 Hz for a further 3 second period. With such a series of sweeps being repeated until the silo is empty or a condition is established in the feedback signals 23 received from the feedback unit 24 to cause vibration to cease. It will be appreciated that the frequency ranges of the sweeps is largely relative to the material being handled by the device and the size of the grains. Thus, the above ranges may be suitable for handling grains, such as barley and wheat, but for more powdery material or irregular grain sizes, other frequency ranges for the sweeps will be employed, In this regard, the feedback unit 24 provides input to the control unit 22 by performing real-time Fast Fourier Transform (FFT) analysis of the amplitude of the detected vibration within the frequency domain of the structural resonance, typically in a range of between 2-200 Hz, considered as being the critical structural resonance zone.

The feedback unit 24 generates two levels of feedback monitoring that are used by the control unit 22 to control the overall stimulus being applied by the vibration unit.

Firstly, the feedback unit 24 provides feedback as to whether any vibration energy is required to assist in the discharge of the grain. As previously discussed, the phenomena of grain-to-grain surface friction reaching equilibrium with the gravitational forces typically is only relevant when the level of grain within the hopper is at the level of the lower cone portion 14. Tests conducted by the Applicant have found that the benefits of applied vibration in the discharge of grain when the hopper is full or the grain is at a level above the lower cone portion is minimal, or provides minimal flow assistance. In this regard, when the feedback unit 24 determines that the level of grain is above the lower cone portion 14, no vibration stimulus is required by the system, as the grain will continue to discharge under the action of gravity.

This determination of the level of the grain present in the hopper may be achieved as follows:

1. Firstly, the vibration system 20 is activated to apply the base vibration algorithm as discussed above. The base vibration algorithm is selected based upon the type of material being handled;
2. The feedback unit 24 then detects the resultant amplitude at the applied vibration frequency (and in some embodiments the first, second and third harmonics may also be included) and generates a resultant signal that is sent to the control unit 22;
3. The control unit 22 then assesses the detected amplitude of the resultant vibration against a set point level after a 10 second interval of continuous vibration. The set point level amplitude is an amplitude level of resultant vibration of the hopper that is predetermined to indicate whether the level of grain present in the hopper is at or below the lower cone portion 14.
4. If the control unit 22 determines that the detected amplitude level of resultant vibration is below the set point level, the control unit 22 sends a signal to the vibration unit to cease vibrating and pauses the base vibration algorithm for a set time delay. Such a condition indicates that the level of grain in the hopper 10 is above the lower cone portion 14 and gravity is performing the grain flow and any applied vibration will have minimal influence on grain discharge.
5. Upon the expiration of the time delay, the control unit then recommences the base vibration algorithm for another ten second interval and the feedback unit 24 detects the amplitude at the resultant vibration at the applied vibration frequency and generates a signal accordingly which is sent to the control unit 22.
6. The control unit 22 again performs the same analysis of the signal as discussed in step 3 above, and looks for a rise in feedback amplitude above the set point level. This cycle repeats until the detected vibration amplitude is determined by the control unit 22 to be above the set point level, indicating that the level of grain in the hopper 10 is at or below the lower cone portion 14. As discussed above, this condition is one in which the likelihood of the grain-to-grain surface friction reaching equilibrium with the gravitational forces is increased, which could cause the grain to stop flowing, and where maximum benefit of applied vibration in the discharge of the hopper is expected. In this situation, the control unit 22 initiates the base vibration algorithm to initiate and facilitate granular flow, until the grain has been evacuated from the hopper 10.

In accordance with the present invention, the vibration system 20 also functions to unsure that the structural integrity of the hopper 10 is maintained throughout the process, and that the hopper is protected from being placed into structural resonance. This is achieved in the following manner:

1. The vibration system 20 activates the base vibration algorithm as discussed above;
2. The feedback unit 24 detects the amplitude of vibration and generates a signal to the control unit 22 accordingly.
3. The control unit 22 then assesses the detected amplitude of vibration received from the feedback unit against a second set point level in the frequency range of 5 Hz to 25 Hz (critical structural resonance zone). As will be appreciated, this frequency range may vary for different Structures.
4. If the detected amplitude of vibration is above the second set point level, for any time interval of more than 0.5 seconds, the control unit 22 sends a signal to the vibration unit 26 to cease operating, for a predetermined period, namely for a period of around ten seconds. At the end of this period, the control unit 22 initiates the vibration unit 26 to recommence the base vibration algorithm, and the feedback unit continues to detect the resultant amplitudes of vibration and generate real-time signals to the control unit 22 where the above described analysis is repeated.
5. If the control unit 22 identifies that three repetitive iterations have been detected by the feedback unit 24 whereby the amplitude of vibration has exceeded the second set point level, then a signal is sent to the vibration unit 26 to cease further operation and an error signal is generated and displayed by the control unit 22. The vibration system 20 can only be reactivated by an external operator restarting the system and being alerted of the error. This algorithm forms an anti resonance part of the system 20.

It will be appreciated that in the discharge of particulate matter from a storage container, such as a silo or hopper, the application of vibration energy to the container may, in some instances, bring about compaction of the particles within the container. Compaction of particles can cause blockages that result in the cessation of flow of the material from the container, and is a condition that is to be avoided.

To reduce the likelihood of compaction from occurring, it may be necessary to provide bursts of vibration in higher or different frequency ranges than may be performed by the base vibration algorithm. In this regard, by way of an example only, whilst the base vibration algorithm may perform a linear sweep between two different set points, e.g. 13 Hz-25 Hz, in order to avoid compaction, the base vibration algorithm may occasionally perform a "burst sweep" at a higher or different frequency range, e.g. 36 Hz-40 Hz. Such a "burst sweep" may have the effect of upsetting the individual grains of dry matter to avoid any compaction from occurring. There may be a multiplicity of set points provided for performing the "burst sweep" which may be predetermined based upon the sizes of the individual grains being handled, in much the same manner as is the case with the setting of the set points for the base algorithm discussed above.

It will be appreciated that the control system of the present invention provides maximum efficiency in applying the vibration energy to the granular material and ensures that the additional vibration energy is only applied when required and when maximum benefit of the vibration is to be obtained, namely when the flow of granular material is likely to become static. Furthermore, the present invention provides a means for ensuring that the structural integrity of the container holding the granular material is maintained, ensuring a safe work environment.

It will also be appreciated that the present invention provides a means for avoiding compaction of the particles from occurring within the storage container as a result of the applied vibration. The present invention has the ability to provide bursts of varying vibration frequency within a base vibration algorithm, to unsettle any compaction that may be occurring within the material. Such a means for avoiding compaction may be tailored in accordance with the particle size and the type of material being handled.

The system and method of the present invention attempts to address the differing flow characteristics of dry bulk materials as they are discharged from a hopper such that the system and method can be tailored to meet the handling of different materials. For grains such as wheat and barley, a frequency range of the base algorithm of 32-40 Hz may be optimal. Similarly, for flour or other powders, a base algorithm with a frequency range between 40-45 Hz may be applied. In any event, by adjusting the frequency of applied vibration to the specific material being handled, the present system and invention can be tailored to the needs of the material without significant alterations to the manner in which the invention functions.

Throughout the specification and claims the word "comprise" and its derivatives are intended to have an inclusive rather than exclusive meaning unless the contrary is expressly stated or the context requires otherwise. That is, the word "comprise" and its derivatives will be taken to indicate the inclusion of not only the listed components, steps or features that it directly references, but also other components, steps or features not specifically listed, unless the contrary is expressly stated or the context requires otherwise, Orientational terms used in the specification and claims such as vertical, horizontal, top, bottom, upper and lower are to be interpreted as relational and are based on the premise that the component, item, article, apparatus, device or instrument will usually be considered in a particular orientation, typically with the vibration unit uppermost.

It will be appreciated by those skilled in the art that many modifications and variations may be made to the methods of the invention described herein without departing from the spirit and scope of the invention.

The claims defining the invention are as follows:

1. A method of discharging dry bulk material from a container, comprising the steps of:

a) applying vibration to the container in accordance with a predetermined vibration application routine;

b) monitoring a resultant amplitude of vibration of the container resulting from the applied vibration;

c) determining a level of dry bulk material present in the container;

wherein, in the event that the determined level of dry bulk material is above a predetermined level, ceasing the application of vibration to the container for a predetermined time interval;

or in the event that the determined level of dry bulk material is at or below a predetermined level, maintaining the application of vibration to the container in accordance with the predetermined vibration application routine.

2. A method according to claim 1, wherein the step of determining the level of dry bulk material present in the container comprises assessing the resultant amplitude of vibration of the container against a predetermined set point level amplitude.

3. A method according to claim 2, wherein the predetermined set point level amplitude is an amplitude of vibration representative of whether the level of dry bulk material is at a lower cone portion of the container.

4. A method according to claim 1, wherein the predetermined vibration application routine comprises applying a linear sweep of vibration to the container between a predetermined frequency range over a predetermined time interval.

5. A method according to claim 1, wherein the step of monitoring the resultant amplitude of vibration comprises mounting an accelerometer to a wall of the container to measure the resultant vibration.

6. A method according to claim 1, wherein the step of ceasing the application of vibration to the container comprises repeating steps a)-c) after the predetermined time interval has lapsed.

7. A method according to claim 1, wherein the step of maintaining the application of vibration to the container in accordance with the predetermined vibration application routine comprises repeatedly applying a linear sweep of vibration to the container between a predetermined frequency range.

8. A method according to claim 7, wherein the predetermined frequency range is determined based on the dry bulk material being discharged.

9. A method according to claim 8, wherein the predetermined frequency range is determined based on a grain size of the dry bulk material being discharged.

10. A method according to claim 7, further comprising a step of monitoring the resultant vibration of the container resulting from the predetermined vibration application routine against a second set point level representative of a critical structural resonance zone of the container.

11. A method according to claim 10, wherein upon determining that the resultant vibration of the container resulting from the predetermined vibration application routine exceeds the second set point level, the predetermined vibration application routine is ceased for a predetermined interval.

12. A method according to claim 11, wherein upon determining that the resultant vibration of the container resulting from the predetermined vibration application routine exceeds the second set point level, the predetermined vibration application routine is ceased until reactivated by an external operator.

13. A method according to claim 7, wherein the predetermined vibration application routine comprises at least one burst of a linear sweep of vibration to the container outside said predetermined frequency levels to avoid compaction of the dry bulk material within the container.

14. A system for discharging dry bulk material from a container, comprising:

a vibration unit attachable to a wall of the container and configured to apply vibration to the container;

a feedback unit attachable to the container so as to determine an amplitude of resultant vibration of the container in response to the vibration applied by the vibration unit and configured to generate a feedback signal indicating said determined amplitude of resultant vibration; and a control unit for controlling the operation of the vibration unit to apply vibration to the container in accordance with a predetermined vibration application routine, monitor a resultant amplitude of vibration of the container resulting from the applied vibration and determine a level of dry bulk material present in the container wherein in the event that the determined level of dry bulk material is above a predetermined level, the controller ceases the application of vibration to the container for a predetermined time interval and in the event that the determined level of dry bulk material is at or below a predetermined level, the controller maintains the application of vibration to the container in accordance with the predetermined vibration application routine.

* * * * *